US006709994B2

(12) United States Patent
Miller et al.

(10) Patent No.: US 6,709,994 B2
(45) **Date of Patent: *Mar. 23, 2004**

(54) STORM PROOF ROOFING MATERIAL

(75) Inventors: David George Miller, Pickerington, OH (US); Carla A. Miller, Newark, OH (US); Margaret M. Woodside, Pickerington, OH (US); Frank J. Macdonald, Granville, OH (US); James S. Belt, Utica, OH (US); William Huykman, St. Louisville, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 45 days.

This patent is subject to a terminal disclaimer.

(21) Appl. No.: 10/055,774

(22) Filed: Jan. 22, 2002

(65) Prior Publication Data

US 2002/0110679 A1 Aug. 15, 2002

Related U.S. Application Data

(62) Division of application No. 09/223,670, filed on Dec. 30, 1998, now Pat. No. 6,426,309.

(51) Int. Cl.[7] ..... B32B 27/04

(52) U.S. Cl. ..... 442/148; 428/142; 442/104; 442/164; 442/167; 442/170; 442/171; 442/364; 442/381; 442/389; 442/390; 427/186; 427/188

(58) Field of Search ..... 428/142; 442/104, 442/148, 164, 167, 170, 171, 364, 381, 389, 390; 427/186, 188

(56) References Cited

U.S. PATENT DOCUMENTS

| | | | |
|---|---|---|---|
| 1,154,334 | A | 9/1915 | Overbury |
| 2,798,822 | A | 7/1957 | Carter |
| 2,893,889 | A | 7/1959 | Schuetz et al. |
| 3,619,343 | A | 11/1971 | Freeman |
| 3,620,810 | A | 11/1971 | Carter |
| 3,813,280 | A | 5/1974 | Olszyk et al. |
| 3,922,425 | A | 11/1975 | Plumberg |
| 3,937,640 | A | 2/1976 | Tajima et al. |
| 4,055,453 | A | 10/1977 | Tajima et al. |
| 4,091,135 | A | 5/1978 | Tajima et al. |
| 4,295,445 | A | 10/1981 | Kopenhaver |
| 4,352,837 | A | 10/1982 | Kopenhaver |
| 4,374,687 | A | 2/1983 | Yamamoto |
| 4,442,148 | A | 4/1984 | Stierli |
| 4,457,983 | A | 7/1984 | Maile et al. |

(List continued on next page.)

FOREIGN PATENT DOCUMENTS

| | | |
|---|---|---|
| EP | 0 012 437 A1 | 6/1980 |
| EP | 208918 A2 | 6/1986 |
| GB | 2 146 270 A | 4/1985 |

OTHER PUBLICATIONS

Ballistic Impact Resistance of SMA and Spectra Hybrid Graphite Composites, from the Journal of Reinforced Plastics and Composites, vol. 17, No. 2/1998.

*Primary Examiner*—Elizabeth M. Cole
*Assistant Examiner*—Norca L. Torres
(74) *Attorney, Agent, or Firm*—Inger H. Eckert; James J. Dottavio

(57) ABSTRACT

An asphalt-based roofing material includes a substrate coated with an asphalt coating, a protective coating adhered to the upper surface of the asphalt coating, a layer of granules adhered to the protective coating, and a web bonded to the lower region of the asphalt coating. A method of manufacturing a roofing material includes coating a substrate with an asphalt coating, applying a protective coating to the upper surface of the asphalt coating, applying a layer of granules to the protective coating, and applying a web to the lower region of the asphalt coating.

21 Claims, 9 Drawing Sheets

U.S. PATENT DOCUMENTS

| | | | |
|---|---|---|---|
| 4,460,635 | A | 7/1984 | Jones et al. |
| 4,470,237 | A | 9/1984 | Lincoln et al. |
| 4,521,478 | A | 6/1985 | Hageman |
| 4,581,090 | A | 4/1986 | Snyder |
| 4,599,258 | A | 7/1986 | Hageman |
| 4,610,902 | A | 9/1986 | Eastman et al. |
| 4,636,414 | A | 1/1987 | Tajima et al. |
| 4,693,923 | A | 9/1987 | McGroarty et al. |
| 5,102,728 | A | 4/1992 | Gay et al. |
| 5,326,797 | A | 7/1994 | Zimmerman et al. |
| 5,380,552 | A | 1/1995 | George et al. |
| 5,434,009 | A | 7/1995 | Urbanek |
| 5,456,785 | A | 10/1995 | Venable |
| 5,516,573 | A | 5/1996 | George et al. |
| 5,571,596 | A | 11/1996 | Johnson |
| 5,822,943 | A | 10/1998 | Frankoski et al. |

STORM PROOF ROOFING MATERIAL

CROSS REFERENCE TO RELATED APPLICATIONS

The present application is a division of U.S. patent application Ser. No. 09/223,670, entitled STORM PROOF ROOFING MATERIAL, filed Dec. 30, 1998 now U.S. Pat. No. 6,426,309.

TECHNICAL FIELD AND INDUSTRIAL APPLICABILITY OF THE INVENTION

This invention relates to asphalt-based roofing materials, and in particular to a roofing material having improved durability and impact resistance to withstand the destructive forces of storms.

BACKGROUND OF THE INVENTION

Asphalt-based roofing materials, such as roofing shingles, roll roofing and commercial roofing, are installed on the roofs of buildings to provide protection from the elements. Typically, the roofing material is constructed of a substrate such as a glass fiber mat or an organic felt, an asphalt coating on the substrate, and a surface layer of granules embedded in the asphalt coating.

The typical roofing material construction is suitable under most circumstances. However, sometimes a roofing material is subjected to environmental conditions that may damage the roofing material. For example, storms are responsible for billions of dollars in damage to roofing materials every year. During storms, hailstones may impact the roofing material, which may cause tears or punctures in the roofing material. The hailstone impacts may also cause an immediate loss of some granules from the impacted areas of the roofing material and a further loss of granules from those areas over time. The loss of granules creates an unattractive appearance and leaves the asphalt coating in those areas unprotected from the degrading effects of the elements. Accordingly, there is a need for a roofing material having an improved ability to withstand the destructive forces of storms.

The prior art does not adequately address the need for a storm proof roofing material. For example, U.S. Pat. Nos. 5,380,552 and 5,516,573, both issued to George et al., disclose a method of improving the adhesion of granules to a roofing shingle, by spraying a thin stream of a low viscosity adhesive to cover 50–75% of the surface of the asphalt coating before applying the granules. The patents teach that granule loss is caused by moisture disrupting the bond between the granule and the asphalt coating. There is no suggestion that granule loss may be related to changes in the asphalt coating over time, or that sufficiently covering the asphalt coating with the adhesive may reduce these changes and the resultant granule loss.

It is known to apply a surface coating onto a roof after the roofing shingles have been installed to protect the shingles from granule loss and other damage. Unfortunately, surface coatings require additional labor to apply after the roofing shingles have been installed, they are relatively expensive, and they may create safety problems by producing a slick roof.

Several patents disclose roofing materials constructed with multiple substrates. For example, U.S. Pat. No. 5,326,797, issued to Zimmerman et al., discloses a roofing shingle including a top mat of glass fibers and a bottom mat of polyester. The patent is related to a fire-resistant shingle, and there is no mention of improved impact resistance. Also, there is no suggestion of improved bonding between the polyester mat and the asphalt coating.

U.S. Pat. No. 5,571,596, issued to Johnson, discloses a roofing shingle including an upper layer of directional fiber such as Kevlar fabric, a middle layer of fibrous mat material such as glass fiber mat, and a lower layer of directional fiber such as E-glass fabric. The upper fiber layer is described as being important to shield the shingle from hail impact damage. The lower layer of E-glass fabric is not effective for improving the impact resistance of the shingle.

U.S. Pat. No. 5,822,943, issued to Frankoski et al., discloses an asphalt-coated roofing shingle including a scrim and a mat. The scrim is bonded to the mat with adhesive; there is no suggestion of improved bonding between the scrim and the asphalt coating. A scrim is not very effective for improving the impact resistance of a roofing shingle.

A journal article, "Ballistic Impact Resistance of SMA and Spectra Hybrid Graphite Composites", Journal of Reinforced Plastics and Composites, Vol. 17, 2/1998, by Ellis et al., discloses placing energy absorbing fibers on the back surface of a graphite composite. The fibers were found to provide only a slight improvement in the impact strength of the composite. The journal article is not related to roofing materials.

It is known to manufacture roofing materials with rubber-modified asphalt to provide some improvement in impact resistance. Unfortunately, roofing materials made with rubber-modified asphalt are more difficult to manufacture, handle, store and install, and they are more expensive, than roofing materials made with conventional roofing asphalt. Also, the rubber-modified asphalt shingles are not very effective in resisting impacts. Accordingly, there is still a need for a roofing material having improved durability and impact resistance to better withstand the destructive forces of storms.

SUMMARY OF THE INVENTION

The above objects as well as others not specifically enumerated are achieved by an asphalt-based roofing material according to the present invention. The roofing material includes a substrate coated with an asphalt coating, a protective coating adhered to the upper surface of the asphalt coating, a surface layer of granules adhered to the protective coating, and a web bonded to the lower region of the asphalt coating. The combination of the protective coating and the web provides a roofing material having both improved durability and improved impact resistance. As a result, the roofing material is better able to withstand the destructive forces associated with storms.

In another embodiment, the roofing material includes a substrate coated with an asphalt coating, a protective coating adhered to the upper surface of the asphalt coating, and a surface layer of granules adhered to the protective coating. The protective coating covers at least about 80% of the upper surface of the asphalt coating in the exposed portion of the roofing material.

The present invention also relates to a method of manufacturing the storm proof roofing material. The method includes the steps of coating a substrate with an asphalt coating, applying a protective coating to the upper surface of the asphalt coating, applying a surface layer of granules to the protective coating, and applying a web to the lower region of the asphalt coating.

In another embodiment, the method includes the steps of applying a web to a substrate, coating the substrate and the web with an asphalt coating, where the web is in contact with the lower region of the asphalt coating, applying a protective coating to the upper surface of the asphalt coating, and applying a surface layer of granules to the protective coating.

In another embodiment, the method includes the steps of coating a substrate with an asphalt coating, moving the asphalt-coated substrate at a speed of at least about 200 feet/minute (61 meters/minute) past an applicator to apply a continuous layer of protective coating to the upper surface of the asphalt coating, and applying a surface layer of granules to the protective coating. The rapid movement of the asphalt-coated substrate creates a boundary layer of air on the upper surface of the asphalt coating, which can create discontinuities in the protective coating. The applicator is positioned sufficiently close to the upper surface of the asphalt coating to minimize the boundary layer and thereby substantially reduce discontinuities in the protective coating.

In a further embodiment, the method includes the steps of coating a substrate with an asphalt coating, providing a solid or molten film of a protective coating material, applying the film to the upper surface of the asphalt coating, and applying a surface layer of granules to the film.

Various objects and advantages of this invention will become apparent to those skilled in the art from the following detailed description of the preferred embodiments, when read in light of the accompanying drawings.

DETAILED DESCRIPTION AND PREFERRED EMBODIMENTS OF THE INVENTION

Figure 1:
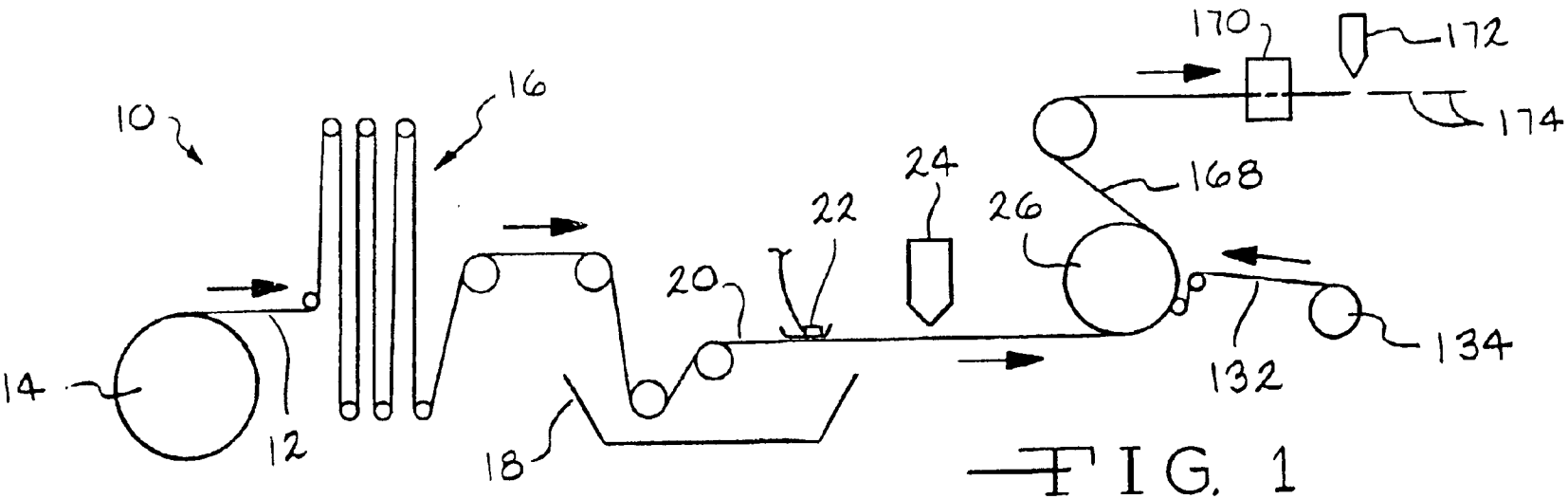
FIG. 1 is a schematic view in elevation of apparatus for manufacturing an asphalt-based roofing material according to the invention.

Referring now to the drawings, there is shown in FIG. 1 an apparatus 10 for manufacturing an asphalt-based roofing material according to the invention. The illustrated manufacturing process involves passing a continuous sheet 12 in a machine direction (indicated by the arrows) through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute). Although the invention is shown and described in terms of a continuous process, it should be understood that the invention can also be practiced in a batch process using discreet lengths of materials instead of continuous sheets.

In a first step of the manufacturing process, a continuous sheet 12 of substrate is payed out from a roll 14. The substrate can be any type known for use in reinforcing asphalt-based roofing materials, such as a web, scrim or felt of fibrous materials such as mineral fibers, cellulose fibers, rag fibers, mixtures of mineral and synthetic fibers, or the like. Combinations of materials can also be used in the substrate. Preferably, the substrate is a nonwoven web of glass fibers.

The sheet of substrate is passed from the roll through an accumulator 16. The accumulator allows time for splicing one roll of substrate to another, during which time substrate within the accumulator is fed to the manufacturing process so that the splicing does not interrupt manufacturing.

Next, the sheet is passed through a coater 18 where an asphalt coating is applied to the sheet. The asphalt coating can be applied in any suitable manner. In the illustrated embodiment, the sheet is submerged in a supply of hot, melted asphalt coating to completely cover the sheet with the tacky coating. However, in other embodiments, the asphalt coating could be sprayed on, rolled on, or applied to the sheet by other means. When an organic felt is used as the substrate, it may be desirable to first saturate the felt with a saturant asphalt, and then coat the upper and lower surfaces of the felt with an asphalt coating containing a filler.

The term "asphalt coating" means any type of bituminous material suitable for use on a roofing material, such as asphalts, tars, pitches, or mixtures thereof. The asphalt can be either a manufactured asphalt produced by refining petroleum or a naturally occurring asphalt. The asphalt coating can include various additives and/or modifiers, such as inorganic fillers or mineral stabilizers, organic materials such as polymers, recycled streams, or ground tire rubber. Preferably, the asphalt coating contains an asphalt and an inorganic filler or mineral stabilizer. Unlike some previous roofing materials, there is no need to modify the asphalt with rubber or similar polymers to improve the durability of the roofing material.

The roofing material of the present invention is provided with improved durability by the application of a protective coating to the upper surface of the asphalt coating. One aspect of the improved durability is a reduction in the loss of granules, which may be caused by hailstones during storms in addition to natural weathering. As shown in FIG. 1, the asphalt-coated sheet 20 is passed beneath an applicator 22, where a protective coating is applied to the upper surface of the asphalt coating. The sheet is then passed beneath a granule dispenser 24 for the application of granules to the protective coating. After deposit of the granules, the sheet is turned around a slate drum 26 to press the granules into the asphalt coating and to temporarily invert the sheet.

Figure 2:
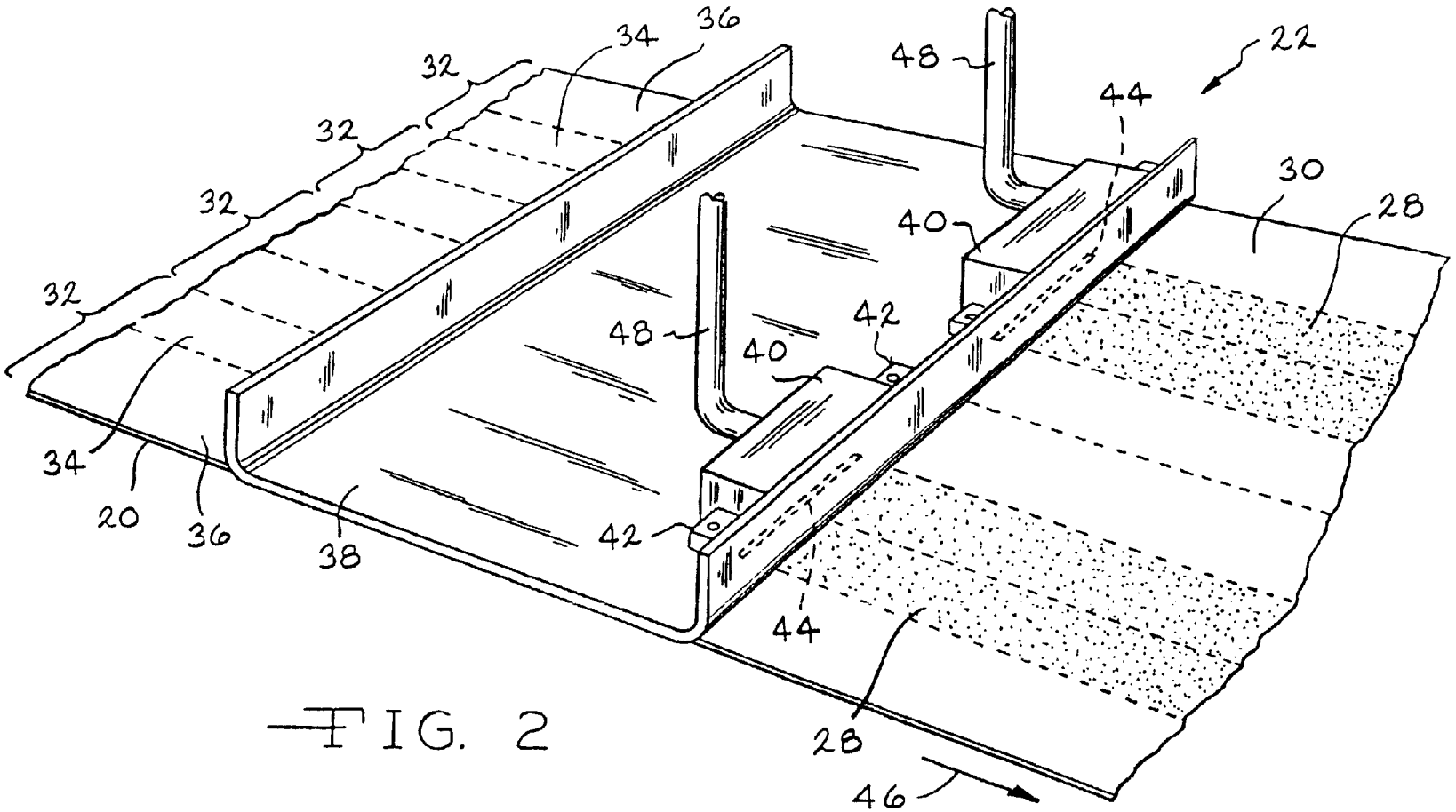
FIG. 2 is a perspective view of part of the manufacturing apparatus of FIG. 1, showing an applicator applying films of protective coating onto the upper surface of an asphalt-coated sheet.

The protective coating can be applied to the upper surface of the asphalt coating by any method suitable for forming a layer that is effective to improve the durability of the roofing material. In a preferred embodiment, the protective coating is applied as a film, which can be a solid, semisolid or molten film. FIG. 2 illustrates an applicator 22 for applying a pair of molten films 28 of protective coating onto the upper surface 30 of the asphalt-coated sheet 20. The sheet can include single or multiple lanes. Four lanes 32 are shown in the illustrated embodiment (indicated by the dotted lines), so that the sheet can be cut into roofing shingles. In the illustrated embodiment, each of the lanes includes a prime portion 34 that is normally exposed to the elements when the roofing material is installed on a roof, and a headlap portion 36 that is normally covered by adjacent shingles when the roofing shingle is installed on the roof. Preferably, the films of protective coating are applied to the prime portions of the sheet, but not to the headlap portions. Application of the protective coating to just the prime portions of the sheet provides improved durability to the portion of the roofing shingle exposed to the elements on a roof, while minimizing the overall cost of the roofing material. However, a film of protective coating can also be applied to cover the entire sheet.

The applicator shown in FIG. 2 includes a support shoe 38, for a purpose that will be described below. Single or multiple dies can be mounted in openings in the support shoe, two dies 40 in the illustrated embodiment, and secured by fasteners such as brackets 42. Each of the dies includes a slot 44 that faces downwardly toward the asphalt coating, and that is oriented transversely to the direction 46 of movement of the sheet. The dies are supplied through heated feed hoses 48 with melted protective coating that is pumped from a storage tank (not shown). The melted protective coating is extruded as a film 28 through the slot of each die onto the upper surface of the asphalt coating. The support shoe prevents the formation of ridges or wakes in the protective coating along the sides of the slot during application of the film.

It was found that the rapid movement of the asphalt-coated sheet creates a boundary layer of air on the upper surface of the sheet, and that when the protective coating is applied, the boundary layer can cause the protective coating to be discontinuous across the area of intended application instead of continuous. In a preferred embodiment, the applicator is positioned sufficiently close to the upper surface of the asphalt coating to minimize the boundary layer and thereby significantly reduce discontinuities in the protective coating. Preferably, the protective coating forms a layer that is at least about 90% continuous (not more than 10% open areas), and more preferably it forms a substantially completely continuous layer. As shown in FIG. 2, the support shoe 38 and dies 40 of the applicator are positioned just in contact with the upper surface 30 of the asphalt-coated sheet 20. Preferably, the applicator is positioned within about 0.1 inch (0.254 cm) of the upper surface.

Figure 3:
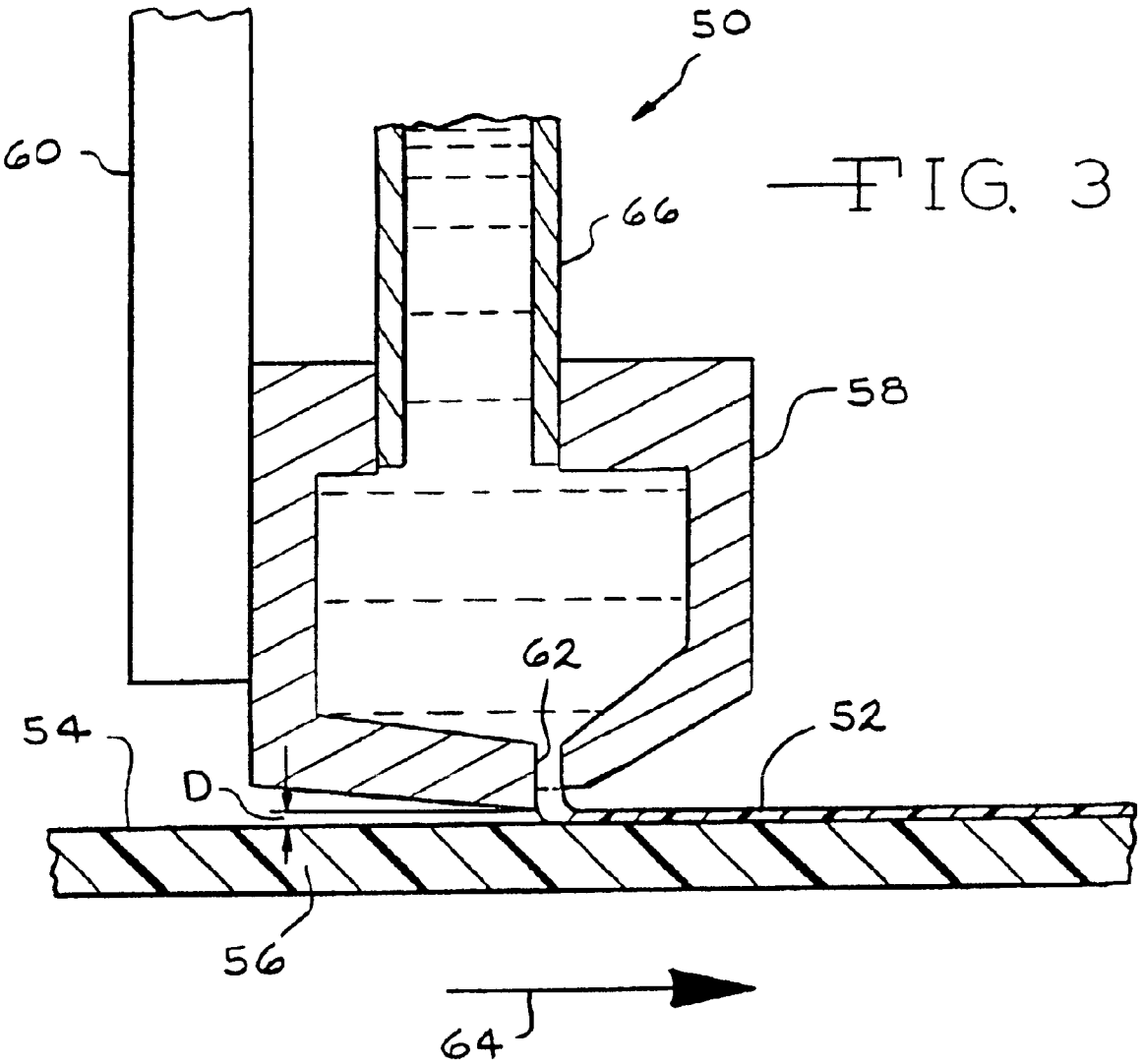
FIG. 3 is a cross-sectional view of an alternate embodiment of an applicator applying a film of protective coating onto the upper surface of an asphalt-coated sheet.

FIG. 3 illustrates another preferred applicator 50 for applying a film 52 of protective coating onto the upper surface 54 of an asphalt-coated sheet 56. A die 58 is mounted on a die mount 60 positioned above the sheet. The die includes a slot 62 that faces downwardly toward the asphalt coating, and that is oriented transversely to the direction 64 of movement of the sheet. The die and slot are positioned a distance D of within about 0.1 inch (0.254 cm) from the upper surface of the sheet. The die is supplied through a heated supply line 66 with melted protective coating that is pumped from a storage tank (not shown). The melted protective coating is extruded through the slot as a film 52 onto the upper surface of the asphalt-coated sheet.

Many other methods can be used for applying the protective coating to the upper surface of the asphalt coating. One method is paying out a previously extruded film of the protective coating material onto the asphalt-coated sheet. Another method is adding protective coating material in particulate form to the upper surface of the asphalt-coated sheet, and then heating the protective coating material to melt it and cause it to flow into a substantially continuous, or unitary layer. A further method is pre-mixing the protective coating material in particulate form into the asphalt coating, so that the protective coating material melts and phase separates from the asphalt coating when the asphalt coating is heated, to provide a substantially continuous, or unitary layer on the asphalt coating. Other suitable methods include spraying and roll coating. "Unitary" is defined as substantially uninterrupted, or continuous. Preferably, the protective coating is fluid enough when the granules are applied that it flows partially around the granules to adhere them to the coating. In a preferred embodiment, the protective coating is applied inmediately after the asphalt coating is applied and immediately before the granules are applied.

Preferably, the protective coating covers at least about 80% of the upper surface of the asphalt coating, in the portion of the roofing material that is exposed on a roof. More preferably, the protective coating substantially completely covers the upper surface of the asphalt coating in the exposed portion. As shown in FIG. 2, the films of protective coating 28 completely cover the prime (exposed) portions 34 of the roofing material. The protective coating preferably has an average thickness of at least about 1 mil (0.025 mm), and more preferably at least about 3 mils (0.076 mm). However, the protective coating is not so thick that it covers the granules and leaves a glossy appearance on the surface of the roofing material. Preferably, the protective coating has an average thickness of not greater than about 60 mils (1.5 mm). Covering the asphalt coating with the protective coating reduces granule loss.

Figure 4:
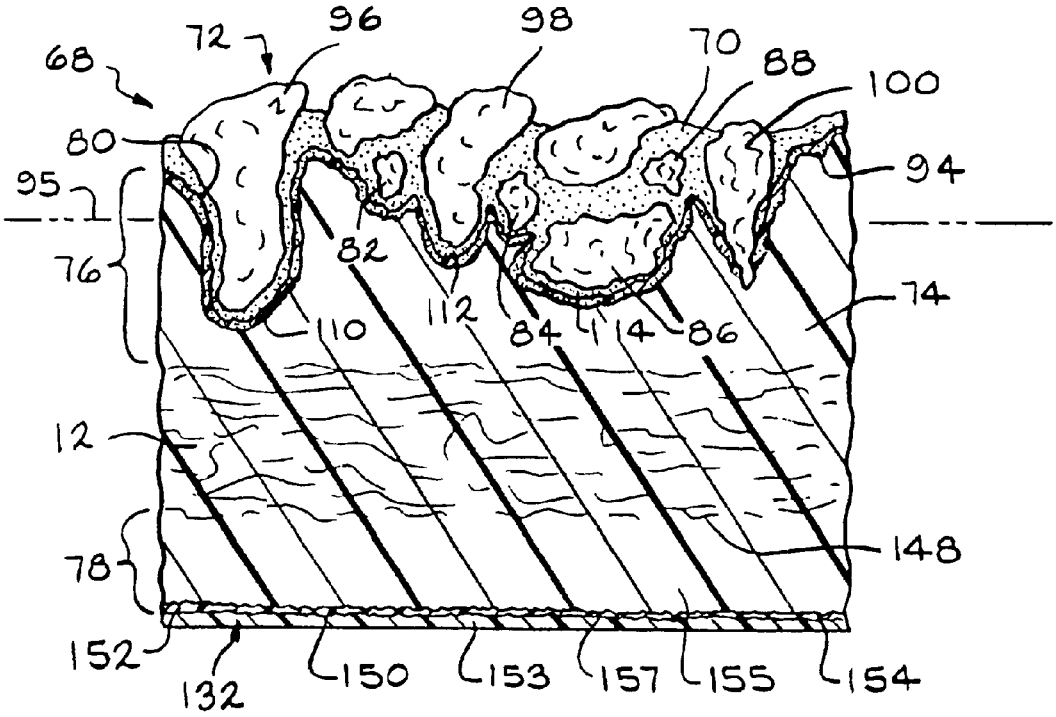
FIG. 4 is an enlarged cross-sectional view of an asphalt-based roofing material according to the invention.
Figure 5:
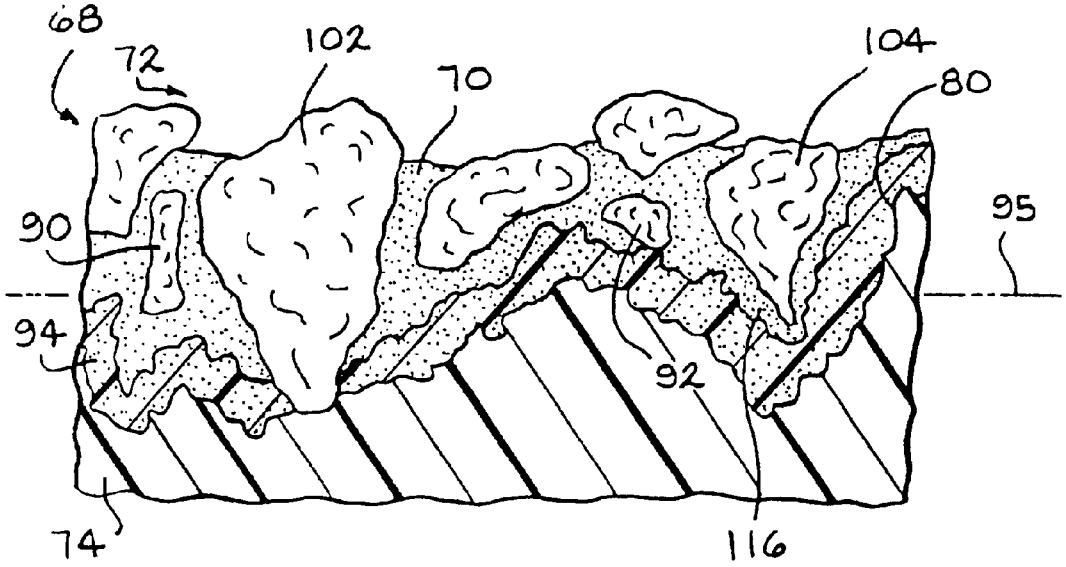
FIG. 5 is a further enlarged cross-sectional view of the upper portion of an asphalt-based roofing material according to the invention.

FIGS. 4 and 5 illustrate a roofing material 68 according to the invention with an applied protective coating 70 and a layer of granules 72. The roofing material includes a substrate 12 that is coated with an asphalt coating 74. The asphalt coating includes an upper region 76 that is positioned above the substrate 12 when the roofing material is installed on a roof, and a lower region 78 that is positioned below the substrate. The upper region includes an upper surface 80. The protective coating 70 is adhered to the upper surface of the asphalt coating. The surface layer of granules 72 is adhered to the protective coating.

It is believed that the protective coating improves the adhesion of the granules by several possible different mechanisms. The granules may adhere more strongly to the protective coating than the asphalt coating, because of the different compositions of the protective coating and the asphalt coating. In some embodiments, the protective coating completely envelops a middle layer of granules to adhere the granules to the roofing material. Preferably, from about 0.5% to about 6% of the total granules are enveloped. In FIG. 4, the protective coating 70 envelops the granules 82, 84, 86 and 88, and in FIG. 5, the protective coating 70 envelops the granules 90 and 92.

The protective coating also adheres strongly to the asphalt coating. In the illustrated embodiment, an interphase region 94 comprises a portion of the protective coating 70 which has been intermingled with a portion of the asphalt coating 74 by melting and mixing, because of the partial miscibility of the protective coating with the asphalt coating. The intermingling strongly adheres the protective coating to the asphalt coating. Some protective coating materials are miscible with the asphalt coating, and others are not miscible. In some embodiments of the invention, the protective coating adheres strongly to the asphalt coating without such intermingling.

As shown in the drawings, the granules 72 have been pressed down into the protective coating 70. Usually, at least a portion of the granules penetrate the asphalt coating 74. "Penetrate" means that a granule extends past an asphalt coating line 95 which is an average upper surface 80 of the asphalt coating 74. In FIG. 4, the granules 96, 98, 84, 86 and 100 penetrate the asphalt coating, and in FIG. 5, the granules 90, 102 and 104 penetrate the asphalt coating. In some embodiments of the invention, a substantially continuous, or unitary layer of the protective coating is maintained between the asphalt coating and the granules that penetrate the asphalt coating. In FIG. 4, layers 110, 112 and 114 of the protective coating are maintained between the granules 96, 98 and 86 and the asphalt coating, and in FIG. 5, a layer 116 is maintained between the granule 104 and the asphalt coating. It was believed beforehand that when a granule was pressed through the layer of protective coating into the asphalt coating, the protective coating layer might not be maintained between the granule and the asphalt coating. Preferably, a substantially continuous, or unitary layer of the protective coating is maintained between the asphalt coating and at least about 30% of the granules that penetrate the asphalt coating. The continuous layer of protective coating around the granules increases the adhesion of the granules to the roofing material.

Additionally, the protective coating may provide a seal to prevent outside moisture from flowing around the granules to the asphalt coating. This may help to prevent degradation of the roofing material. In FIG. 4, the protective coating may provides a seal to prevent moisture from flowing around the granule 100 to the asphalt coating, even though the granule penetrates the asphalt coating. The protective coating forms a tight seal completely around the perimeter of the granule. Similarly, in FIG. 5, the protective coating provides a seal around the granule 102.

The protective coating can be any material suitable for forming a layer that is effective to improve the durability of the roofing material, such as any type of thermoplastic, thermoset, or asphalt-based polymeric materials. In a preferred embodiment, the polymeric material functions as an adhesive. Similarly, the adhesive can include any type of thermoplastic, thermoset, or asphalt-based adhesive that is effective to adhere the granules to the asphalt coating. Some examples of suitable hot-melt adhesives include ethylene-vinyl acetate copolymers, ethylene-ethyl acetate copolymers, ethylene-n-butylacrylate polymers, ethylene-methacrylate polymers, styrene-isoprene-styrene block or graft copolymers, styrene-butadiene-styrene block or graft copolymers, other styrene-containing block or graft copolymers, polyamide terpolymers, hydrocarbon rubbers, polyethylenes, polyesters, polyurethanes, siloxanes, and mixtures/combinations of these materials. Preferred adhesives for use in the invention are flexible ethylene-vinyl acetate copolymers, ethylene-vinyl acetate copolymers modified with styrene-butadiene-styrene block copolymers, and tackified polyethylenes. Preferably, the adhesive is selected so that it adheres to the roofing granules predominantly by polar bonding. For example, ethylene-vinyl acetate copolymers adhere to conventional coated (painted) roofing granules predominantly by polar bonding. The adhesive can be modified with materials such as styrene butadiene polymers, polyolefin polymers, styrene isoprene polymers, petroleum derived tackifying resins, rosin derived tackifying resins, terpene derived tackifying resins, paraffin waxes and oils, microcrystalline waxes and oils, and napthanic waxes and oils.

A stabilizer can be added to the protective coating to tailor the protective coating to specialized conditions, such as extreme exposures of ultraviolet light, solar radiation, and/or temperature. The protective coating can also contain other additives such as algicides, fungicides, or pigments.

Figure 6:
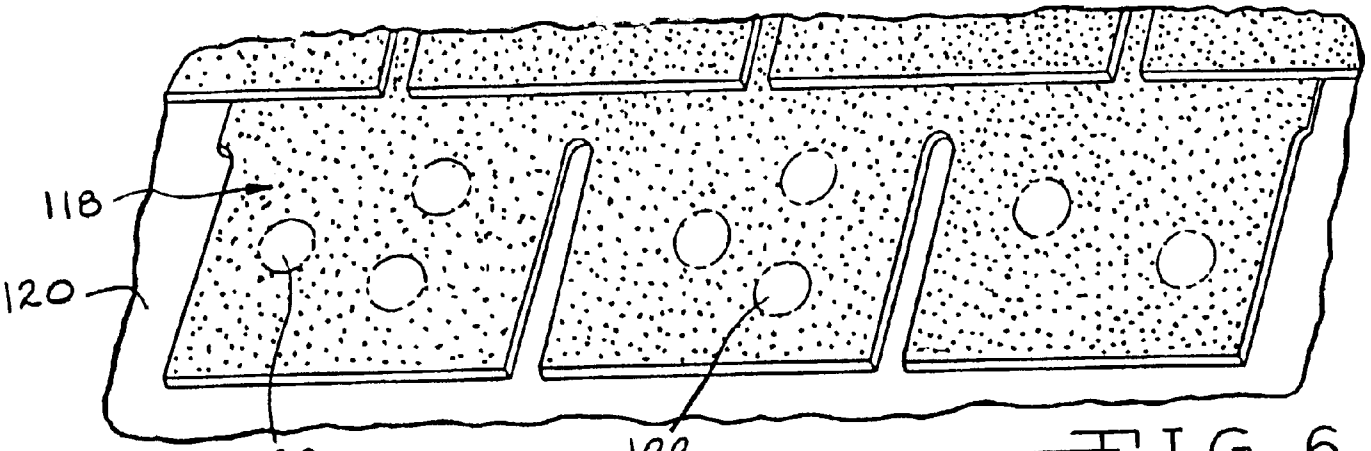
FIG. 6 PRIOR ART
FIG. 6 is a perspective view of a prior art roofing shingle installed on a roof, showing a loss of granules after a period of time caused by impacts on the roofing shingle.
Figure 7:
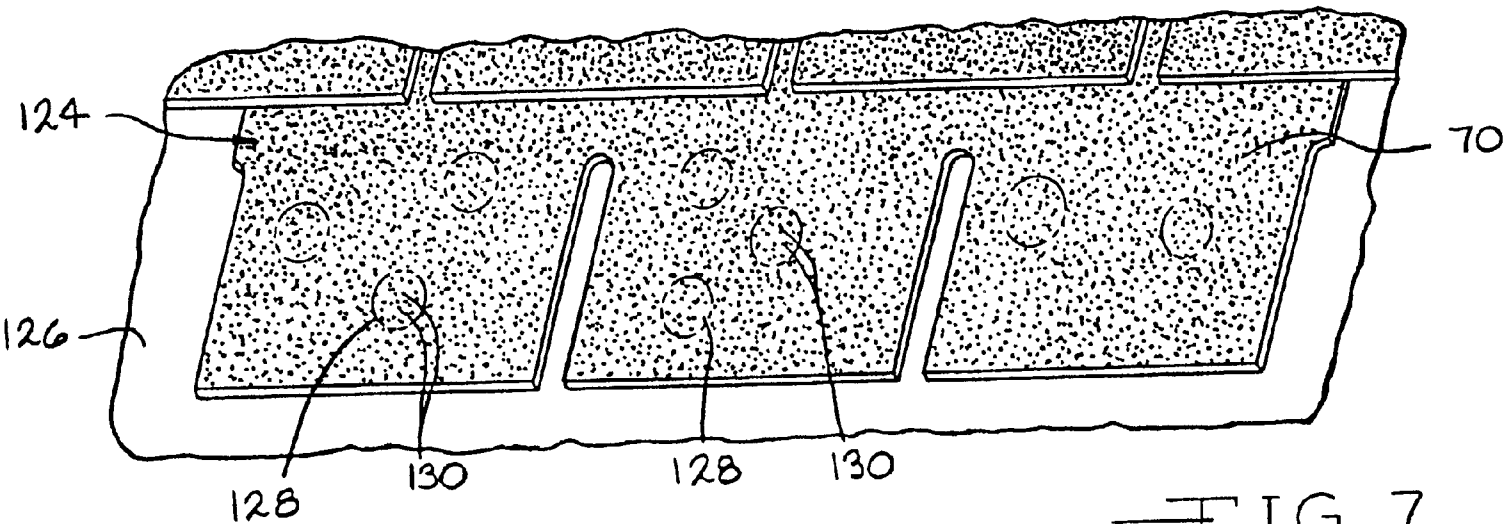
FIG. 7 is a perspective view of a roofing shingle according to the invention installed on a roof, showing substantially no granule loss over the same period of time after being impacted.

FIGS. 6 and 7 illustrate the effect of the protective coating in providing improved durability to a roofing shingle, particularly improved retention of granules. FIG. 6 shows a prior art roofing shingle 118, without the protective coating, installed on a roof 120. The roofing shingle has been subjected to impacts at several areas 122, creating depressions in those areas. After a period of time, the granules on the impacted areas lose their adhesion and they are lost from the roofing material. The loss of granules leaves the asphalt coating in the impacted areas exposed to the elements. The exposed asphalt coating becomes eroded from the effects of weathering on the asphalt coating. The resulting roofing shingle has an unattractive appearance and, ultimately, will no longer be effective to protect the building.

In contrast, FIG. 7 shows a roofing shingle 124 with a protective coating 70 according to the present invention, installed on a roof 126. The roofing shingle has also been subjected to impacts at several areas 128, creating depressions in those areas. Unlike the prior art roofing shingle, the roofing shingle with the protective coating retains the granules 130 in the impacted areas after the same period of time. The asphalt coating in those areas is protected by the granules, so that the roofing shingle maintains its effectiveness and attractive appearance.

Referring again to FIG. 1, the roofing material of the present invention also includes a web 132. The web is selected for the type of web, and is positioned and bonded in such a manner, as to provide the roofing material with improved impact resistance to a variety of impacts. The improved impact resistance eliminates the occurrence of punctures or tears in the roofing material caused by impacts, and thereby maintains the integrity of the roofing material. The roofing material retains its ability to protect the building from the elements so that, for example, water leaks are avoided. As shown in FIG. 1, the web 132 is payed out from a roll 134 onto the lower surface of the sheet 20 while the sheet is inverted on the slate drum 26.

Figure 8:
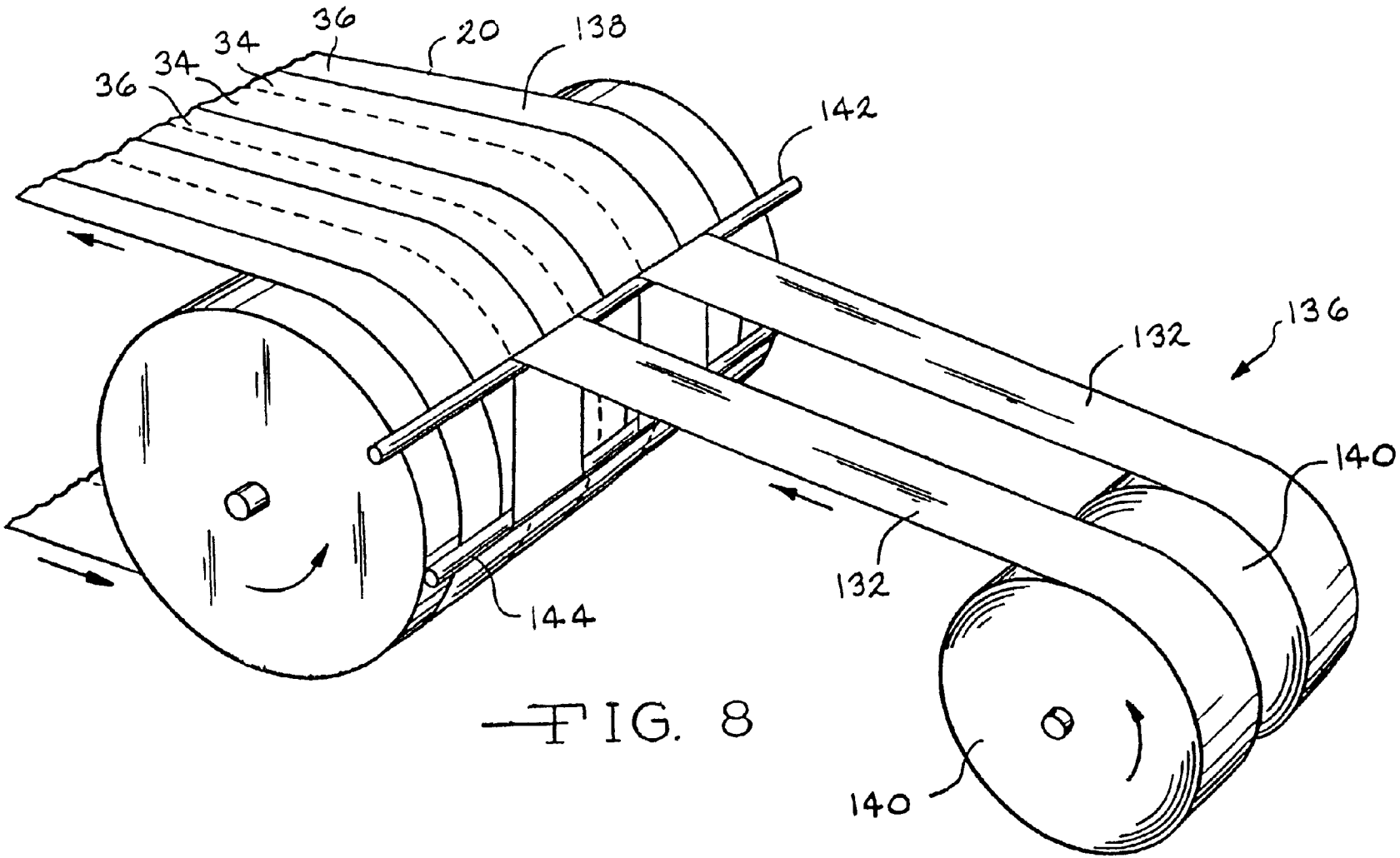
FIG. 8 is a perspective view of part of the manufacturing apparatus of FIG. 1, showing apparatus for applying webs to the lower surface of a sheet of asphalt-coated substrate.

FIG. 8 illustrates a preferred apparatus 136 for paying out continuous webs 132 onto the lower surface 138 of the sheet 20. The webs are payed out from rolls 140. The webs are fed around first and second guide bars 142 and 144 to maintain tension on the webs. The second guide bar 144 is positioned adjacent and parallel with the slate drum 26, so that the webs are aligned properly with the sheet when they are fed onto the lower surface of the sheet. As the sheet turns around the slate drum, the asphalt coating is still hot, soft and tacky, so that the webs adhere to the lower surface of the asphalt coating and are pulled around the slate drum along with the sheet. Preferably, the webs are applied to the lower surface of the sheet in the prime portions 34, but not in the headlap portions 36. Application of the web beneath just the prime portion of a roofing material provides improved impact resistance to the portion of the roofing material exposed to the elements on a roof, while minimizing the overall cost of the roofing material.

Figure 9:
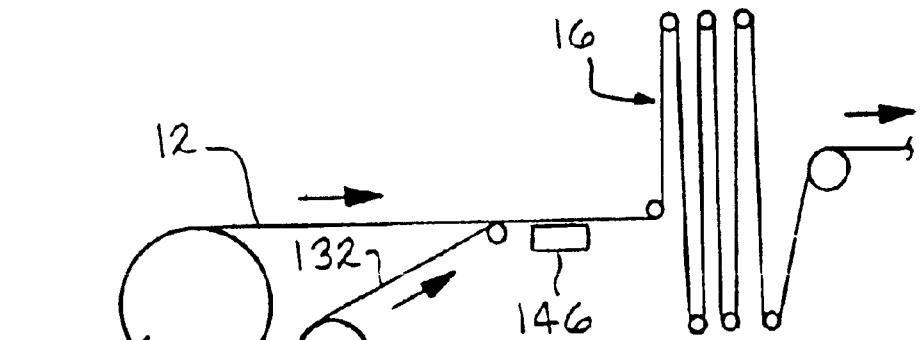
FIG. 9 is a schematic view in elevation of an alternate embodiment of the apparatus of FIG. 8, showing the web being applied to the lower surface of a substrate before coating the web and substrate with asphalt coating.

In an alternate embodiment shown in FIG. 9, the web 132 is payed out from a roll 134' onto the lower surface of the substrate sheet 12 prior to coating both the web and the substrate with asphalt coating. Preferably, the web is bonded to the substrate prior to the asphalt coating step, either intermittently or continuously along their lengths. Any suitable bonding apparatus 146 can be used to bond the web to the substrate. Some examples of bonding methods include heat sealing, ultrasonic welding, pressure sensitive or hot melt adhesive, electrostatic bonding, and physical intertwining by such means as needling or stitching. Bonding the web to the substrate fixes the position of the web relative to the substrate in both the machine and cross directions of the sheet. The bonding also helps to minimize any shrinkage or wrinkling of the web that may occur during the asphalt coating step.

Referring again to FIG. 4, the web 132 is bonded to the lower region 78 of the asphalt coating 74. The bonding of the web to the lower region of the asphalt coating, rather than the upper region 76, has been found to provide an unexpected improvement in resistance to a variety of impacts. Unlike the roofing shingle disclosed in U.S. Pat. No. 5,571,596 to Johnson, there is no need to add a layer of impact-resistant material to the upper region of the asphalt coating.

The web can be bonded to the asphalt coating at any location in the lower region. The "lower region" 78 of the asphalt coating 74 includes any location between the lower surface 148 of the substrate 12 and the lower surface 150 of the asphalt coating. In the preferred embodiment shown in FIG. 4, the web is bonded to the lower surface of the asphalt coating. It has been found that bonding the web to the lower surface of the asphalt coating achieves a superior impact resistance.

Preferably, the roofing material of the present invention includes a strong bond between the web and the asphalt coating, to ensure that the web does not separate from the asphalt coating. If the web separates from the asphalt coating, it is not effective to dissipate the energy of an impact on the roofing material. The strong bond is achieved by fusing the web and the asphalt coating. Specifically, a portion of the web and of the asphalt coating are intermingled by melting, thereby fusing the web and the asphalt coating. "Intermingled" includes any type of physical and/or chemical intermingling of the web and the asphalt coating, to provide a strong mechanical and/or chemical bond.

As shown in FIG. 4, the roofing material includes an interphase region 152 where intermingling by melting has occurred between a portion of the web 132 and a portion of the lower region 78 of the asphalt coating, because of the partial miscibility of the melted web and the melted asphalt coating. The interphase region is usually a non-homogenous region including various concentrations of melted asphalt coating, partially or completely melted web, and mixtures of melted asphalt coating and melted web. The interphase region 152 is a different composition from either the remaining portion 153 of the web or remaining portion 155 of the lower region 78 of the asphalt coating. Thus, the intermingling can include varied degrees of mixing between the web and the asphalt coating. In the illustrated embodiment, the intermingling also includes an irregular interface 154 or boundary between the interphase region 152 and the pure asphalt coating 155. The irregular interface 154 is comprised of peaks and valleys that have resulted from interpenetration between the interphase region and the pure asphalt coating. The irregular interface enhances the bond between the web and the asphalt coating. A portion 153 of the web 132 may have no intermingling with the asphalt coating, thereby forming an interface 157 between the interphase region 152 and the portion 153 of the web.

In a preferred embodiment, the fusing of the web and the asphalt coating is facilitated by the use of a two-component web. The two-component web is comprised of a first component having a first melting point, and a second component having a second melting point that is lower than the first melting point. During the manufacture of the roofing material, at least a portion of the second component is intermingled with the asphalt coating by melting, thereby fusing the web and the asphalt coating. "At least a portion" means that some or all of the second component is intermingled with the asphalt coating by melting. Some portion of the first component may also be intermingled by melting, so long as the web maintains enough of its structure to be effective to improve the impact resistance of the roofing material.

Preferably, the second component has a melting point at least about 50° F. (28° C.) lower than the melting point of the first component, and more preferably at least about 100° F. (56° C.) lower. The asphalt coating usually has a processing temperature within the range of between about 325° F. (163° C.) and about 450° F. (232° C.). Preferably, the second component has a melting point not higher than about 400° F. (204° C.), and more preferably not higher than about 385° F. (196° C.), so that at least a portion melts in contact with the asphalt coating. Preferably, the first component has a melting point not lower than about 350° F. (177° C.) so that it remains substantially solid in contact with the asphalt coating.

Figure 11:
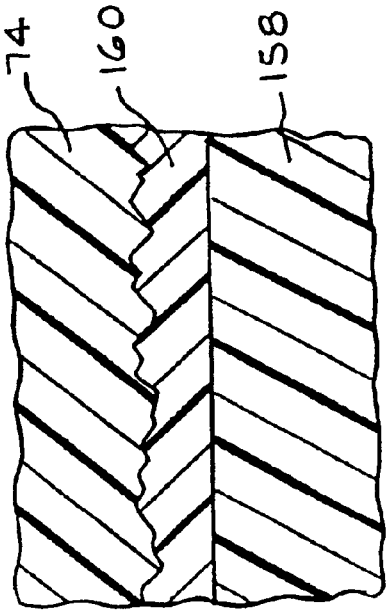
FIG. 11 is a further enlarged cross-sectional view of the web of FIG. 10 in contact with an asphalt coating, showing the second component of the web intermingled by melting with a portion of the asphalt coating.
Figure 10:
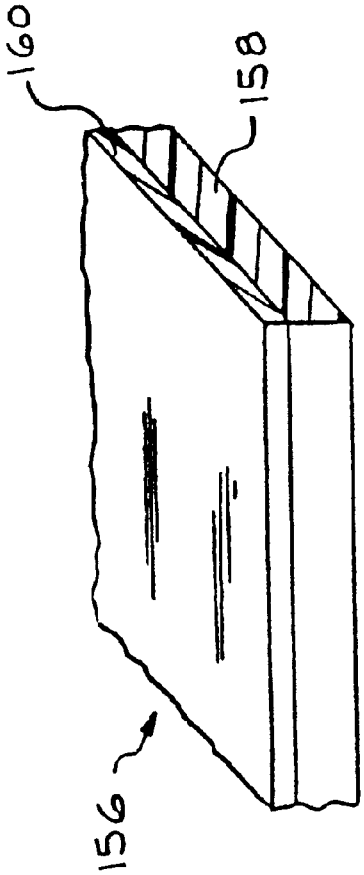
FIG. 10 is an enlarged perspective view, partially in cross-section, of a two-component web for use in an asphalt-based roofing material according to the invention.

FIGS. 10 and 11 illustrate a two-component film 156 that is useful as the web. As shown in FIG. 10, the film comprises a first layer 158 of a first component laminated to a second layer 160 of a second component. As shown in FIG. 11, the second layer 160 has been intermingled with the asphalt coating 74 by melting.

Figure 13:
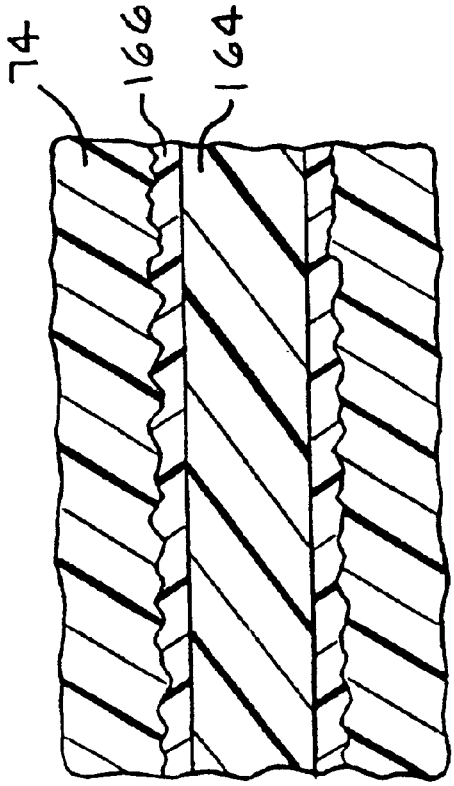
FIG. 13 is a further enlarged cross-sectional view of the sheath/core fiber of FIG. 12 surrounded by an asphalt coating, showing the sheath of the fiber intermingled by melting with a portion of the asphalt coating.
Figure 12:
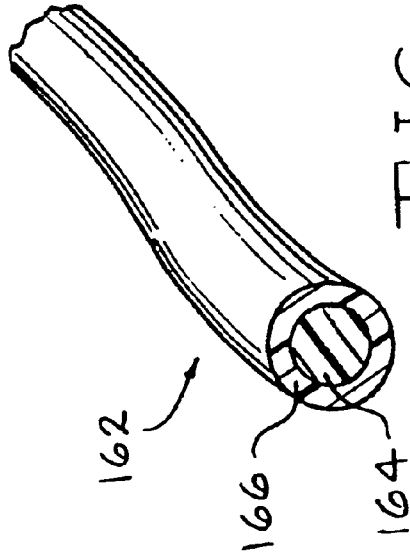
FIG. 12 is an enlarged perspective view, partially in cross-section, of a sheath/core fiber of a web for use in an asphalt-based roofing material according to the invention.

In another embodiment, the web is comprised of two-component fibers. Preferably, the two-component web is a nonwoven web of sheath/core fibers. As shown in FIG. 12, a sheath/core fiber 162 includes a core 164 comprised of a first component, and a sheath 166 comprised of a second component having a lower melting point than the melting point of the first component. As shown in FIG. 13, the sheath 166 has been intermingled with the asphalt coating 74 by melting.

A variety of different types of web are suitable for use in the present invention. The material and structure of the web are chosen so that the web is effective to improve the impact resistance of the roofing material. Specifically, the web is effective to dissipate the energy of an impact on the roofing material. Preferably, the material of the web has good tensile flexure properties, so that it can dissipate the impact energy. A glass mat is unsuitable for use as the web because of its limited elongation properties. Also preferably, the structure of the web is substantially continuous along its length and width so that it can transmit energy waves uninterrupted from the point of impact to the edges of the web. For this reason, a scrim is not preferred for use as the web.

Preferably, the web is also a material which has components that can fuse to the asphalt coating by having a portion of the web melt and intermingle with the asphalt coating. Thermoplastic polymer components are preferred for use in the web because they are capable of partially melting in contact with the hot asphalt coating. On the other hand, thermoset polymer components will not melt in contact with the coating. Usually, the web material is at least partially miscible with the asphalt coating.

Also preferably, the web can be cut cleanly and easily during the roofing material manufacturing process, such as when the sheet of roofing material is cut into shingles and when the tabs are cut in a shingle. The clean cutting means that no strings or other portions of the web material are seen protruding from the edges of the cut roofing material.

It is preferred that the web does not substantially shrink in contact with the hot asphalt coating, thus providing total surface coverage. Also preferably, the material of the web has a coefficient of friction that prevents the roofing material from sliding off a roof during installation.

Some materials that may be suitable for use as the web include mats, webs, films, fabrics, veils, scrims, similar structures, or combinations of these materials. The mats include, for example, airlaid spunbonds, netting, and hydroentangled fibers. The films include, for example, rigid polyvinyl chloride, flexible polyvinyl chloride, polycarbonate, ionomer resin (e.g., Surlyn®), and polyvinylidene chloride (e.g., Saran Wrap®).

A preferred material for use as the web is a nonwoven web of two-component thermoplastic polymer fibers, such as the sheath/core fibers described above. Preferred webs of sheath/core fibers are commercially available from PGI Inc., 1301 E. 8th St., North Little Rock, Ark. 72114. For example, PGI 4103, PGI 4124 and PGI 4104 are nonwoven webs of sheath/core fibers, each fiber including a core of polyethylene terephthalate and a sheath of polyethylene. The sheaths of the fibers are heat bonded together in the web to hold the web together. These products are available in a variety of nonwoven forms, including lofted and densified forms. A preferred form is densified to 1.0 ounce per square yard (33.9 grams per square meter). The web of sheath/core fibers fuses well to the asphalt coating.

The web can be applied and fused to the lower region of the asphalt coating in any suitable manner. As described above, the preferred method is to coat the substrate with the asphalt coating, and then to apply the web to the lower surface of the coating. A portion of the web melts in contact with the hot asphalt coating and, because of the partial miscibility of the web and the coating, intermingles with the coating to fuse the web and the coating. It has been found that some types of web melt better if they are applied to the asphalt-coated sheet, instead of first being applied to the substrate and then coated along with the substrate. Some types of web will melt too well in the asphalt coater, which may cause them to shrink or tear.

Another method of fusing the web and the asphalt coating is to apply a web that does not initially melt in contact with the coating, but that is partially melted and intermingled with the coating later in the process by applying heat to the web and/or the coating. Another method is to extrude a molten film of the web material onto the lower surface of the asphalt-coated sheet, and then to solidify the web by cooling. Another method is to apply a web to the asphalt-coated sheet, where the web is fully miscible with the asphalt coating, but where the heat history of the web limits the migration of the web into the asphalt coating. Still another method is to mix the material of the web with the asphalt coating during manufacture of the coating; when the asphalt coating is heated in the coater, the material of the web separates and migrates to the surface of the asphalt coating. Other suitable methods are also envisioned.

It should be noted that the web can be manufactured separately before the shingle manufacturing process, or it can be manufactured simultaneously with manufacturing the shingle. It should also be noted that release tapes can be incorporated into part of the web to facilitate separation of the roofing shingles from one another after packaging and shipping. Alternatively, a release material such as silicone can be integrated into the web in parts of the web.

Referring again to FIG. 1, after the web 132 is applied, the sheet 168 of asphalt-based roofing material is reinverted, and then cooled by any standard cooling apparatus 170, or allowed to cool at ambient temperature.

The sheet of asphalt-based roofing material is then cut by a cutting apparatus 172 into individual shingles 174, into pieces to make laminated shingles, or into suitable lengths for commercial roofing or roll roofing. The roofing material is then collected and packaged.

Figure 15:
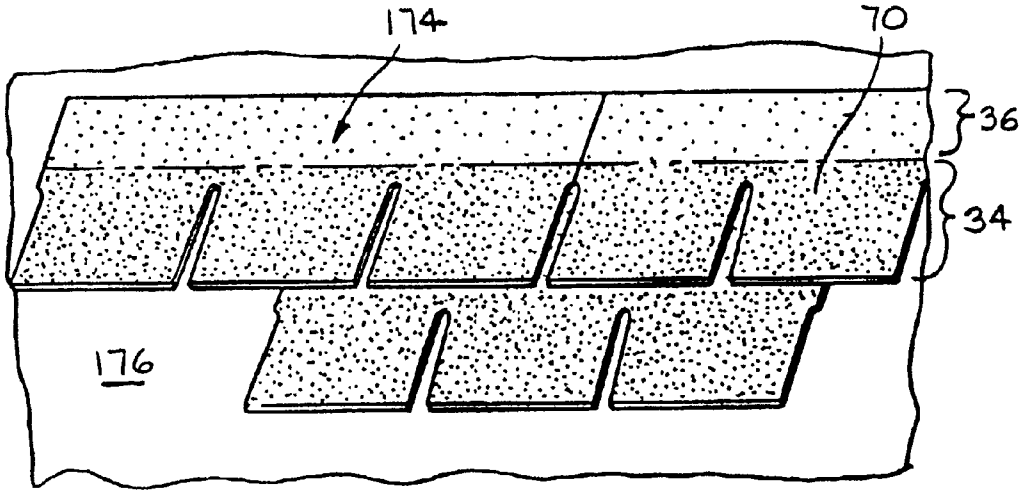
FIG. 15 is a perspective view of several three-tab roofing shingles according to the invention installed on the side of a roof.
Figure 14:
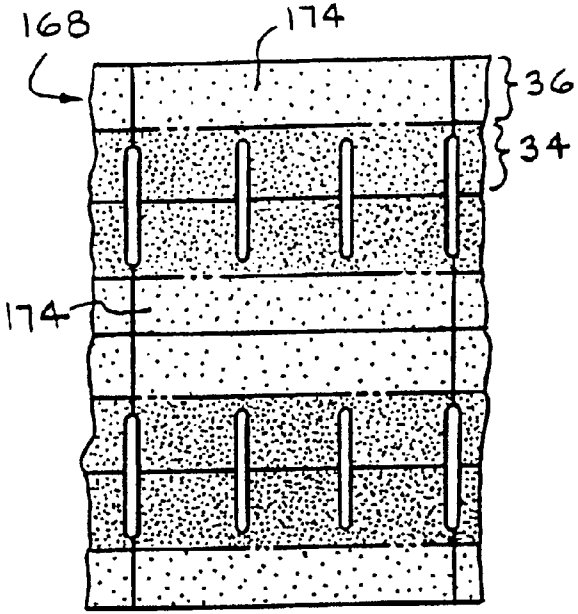
FIG. 14 is a top view of a sheet of roofing material manufactured with the apparatus of FIG. 1, showing the roofing material after being cut but before separation into roofing shingles.

FIG. 14 illustrates the sheet 168 of roofing material after it has been cut into three-tab roofing shingles 174 but before separating the shingles from the sheet. FIG. 15 illustrates several roofing shingles 174 installed on the side of a roof 176. As shown in FIGS. 14 and 15, each roofing shingle includes a prime (exposed) portion 34 and a headlap (covered) portion 36. As indicated by the areas of denser dots, the protective coating 70 is applied to the prime portion but not the headlap portion of each shingle. The web is positioned beneath the prime portion but not the headlap portion.

Figure 16:
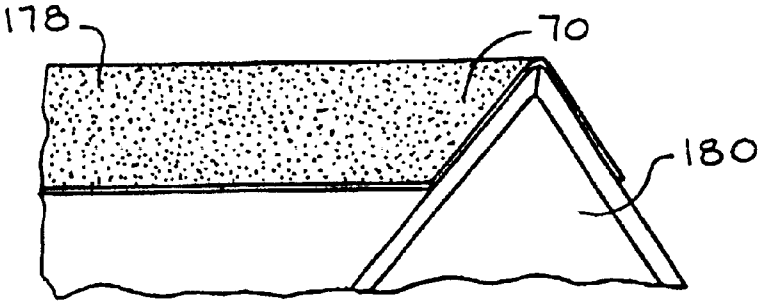
FIG. 16 is a perspective view of a hip and ridge roofing shingle according to the invention installed on the ridge of a roof.

FIG. 16 illustrates a hip and ridge roofing shingle 178 according to the invention installed on the ridge 180 of a roof. The protective coating 70 and web are applied to the entire shingle because the entire shingle is exposed to the elements on the roof.

Figure 17:
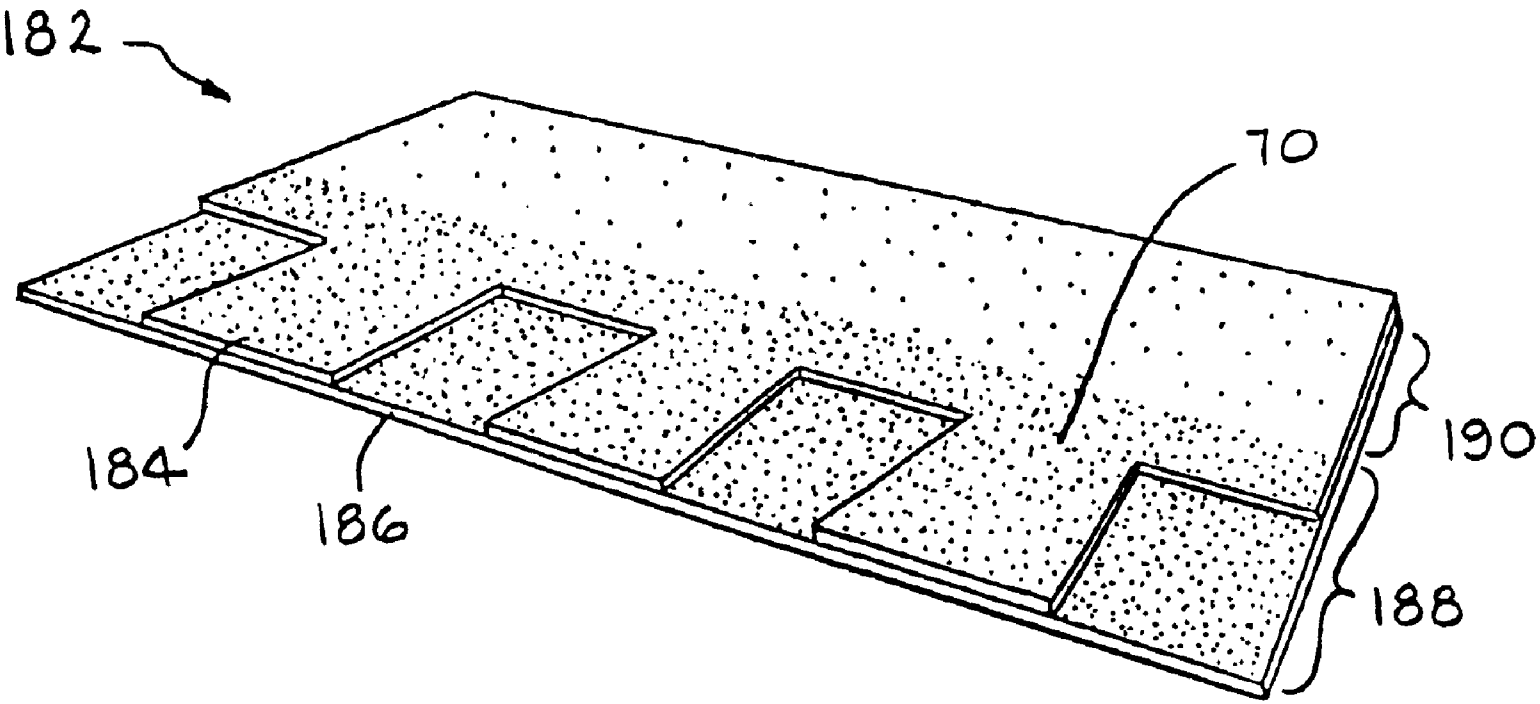
FIG. 17 is a perspective view of a laminated roofing shingle according to the invention.

FIG. 17 illustrates a laminated roofing shingle 182 according to the invention. The laminated shingle is comprised of two pieces of roofing material, an overlay 184 and an underlay 186, which are secured together by adhesive or other means. The laminated shingle includes a prime portion 188 and a headlap portion 190. As indicated by the area of denser dots, the protective coating 70 is applied to the prime portion but not the headlap portion of the shingle. The web is positioned beneath the prime portion of the underlay but not the headlap portion.

It should be understood that, although the improved durability provided by the protective coating is mainly described in terms of reduced granule loss, the protective coating also provides many other advantages. For example, the protective coating may prevent or reduce fracturing of the asphalt coating resulting from impacts on the roofing material. The improved durability provided by the protective coating may allow increased flexibility in selecting the composition and materials of the roofing material. The protective coating may provide a moisture barrier that reduces blistering potential and algal growth. The protective coating may reduce cracking of shingles on a roof, and may partially heal any cracks that occur. The protective coating may provide a more uniform surface that may reduce shading. Additionally, the protective coating may reduce sticking within a bundle of shingles. Other advantages are also envisioned for the protective coating. Walkability and scuffing performance are not negatively affected by the addition of the protective coating.

Although the improved impact resistance provided by the web is mainly described in terms of resistance to impact from hailstones, the web may also provide improved resistance to other types of impact on the roofing material.

The roofing material of the invention includes any type of roofing material, such as shingles with or without tabs, laminated shingles of various designs, commercial roofing and roll roofing. The invention is intended to be applicable to any current or future designs of roofing materials.

Granule Adhesion Testing:

Roofing shingles including different types of protective coating according to the invention were tested for granule adhesion compared to the same kind of roofing shingle without the protective coating (the "control" shingle). Three different adhesives were tested as the protective coating: flexible ethylene-vinyl acetate copolymers (Reynco 52-057, Reynolds Co.); ethylene-vinyl acetate copolymers modified with styrene-butadiene-styrene block copolymers (Reynco 52-146); and tackified polyethylene (Reynco 52-115). The adhesive was applied as a film 5 mils (0.13 mm) thick on a three tab shingle in a standard manufacturing facility. The adhesive completely covered the prime portion of the roofing shingle.

The shingles were subjected to accelerated testing to simulate the effects of weathering and hail impact. The shingles were subjected to 60 days exposure to alternating cycles of concentrated solar radiation and water spray. The shingles were then cooled to 14° F. (−10° C.), and a test coupon from each shingle was subjected to a UL 2218 Class 4 impact. A circle 1 inch (2.4 cm) in diameter at the area of impact was then inspected for the area percentage of granules lost. The control shingle lost approximately 44% of the granules from the area of impact. In contrast, the shingle coated with the ethylene-vinyl acetate copolymers lost only about 3% of the granules, the shingle coated with the SBS-modified ethylene-vinyl acetate copolymers lost only about 5% of the granules, and the shingle coated with the polyethylene lost only about 2% of the granules.

Impact Resistance Testing:

The improved impact resistance of the roofing materials of the present invention is demonstrated by the use of a standard method, UL 2218, "Standard for Impact Resistance of Prepared Roof Covering Materials", Underwriters Laboratories, May 31, 1996. In this method, the roofing material is secured to a test deck, and a steel ball is dropped vertically through a tube onto the upper surface of the roofing material. The roofing material can be tested at four different impact force levels: Class 1 (the lowest impact force) through Class 4 (the highest impact force). The force of impact in the different classes is varied by changing the diameter and weight of the steel ball, and the distance the ball is dropped. For example, the Class 1 test uses a steel ball having a diameter of 1.25 inches (32 mm) weighing 0.28 pounds (127 g) that is dropped a distance of 12 feet (3.7 m), while the Class 4 test uses a steel ball having a diameter of 2 inches (51 mm) weighing 1.15 pounds (521 g) that is dropped a distance of 20 feet (6.1 meters). After the impact, the roofing material is inverted and bent over a mandrel in both the machine and cross directions, and the lower surface of the roofing material is examined visually for any evidence of an opening or tear. A 5×magnification device may be used to facilitate the examination of the roofing material. If no evidence of an opening is found, the roofing material passes the impact resistance test at the UL 2218 class tested. Preferably, a roofing material having a web according to the present invention has an increased impact resistance of at least two UL 2218 classes compared with the same roofing material without the web. More preferably, the roofing material meets a UL 2218 Class 4 impact resistance standard.

The principle and mode of operation of this invention have been described in its preferred embodiments. However, it should be noted that this invention may be practiced otherwise than as specifically illustrated and described without departing from its scope.

What is claimed is:

1. An asphalt-based roofing material comprising:

a substrate coated with an asphalt coating, the asphalt coating including an upper surface that is positioned above the substrate when the roofing material is installed on a root, and a lower region that is positioned below the substrate when the roofing material is installed on the roof, a protective coating adhered to the upper surface of the asphalt coating, a surface layer of granules adhered to the protective coating, and a web bonded to the lower region of the asphalt coating, the web comprising materials having an ultimate tensile elongation of greater than about six percent.

2. The roofing material of claim 1 which, when tested under impart resistance test UL 2218, exhibits an impact resistance improvement of at least two UL 2218 classes compared with the same roofing material without the web.

3. The roofing material of claim 1 including a portion that is normally exposed when the roofing material is installed on a roof, in which the protective coating covers at least about 80% of the upper surface of the asphalt coating in the exposed portion of the roofing material.

4. An asphalt-based roofing material including a portion that is normally exposed when the roofing material is installed on a roof, the roofing material comprising:

a substrate coated with an asphalt coating, the asphalt coating including an upper surface that is positioned above the substrate when the roofing material is installed on the roof, a protective coating adhered to the upper surface of the asphalt coating, the protective coating comprising a unitary layer covering at least about 80% of the upper surface of the asphalt coating in the exposed portion of the roofing material, and a surface layer of granules adhered to the protective coating.

5. The roofing material of claim 4 in which a substantially continuous layer of the protective coating is maintained between the asphalt coating and at least about 30% of the granules that penetrate the asphalt coating.

6. The roofing material of claim 4 which, after aging by 60 days exposure to alternating cycles of concentrated solar radiation and water spray, then cooled to 14° F. (−10° C.)

and subjected to a UL 22 18 Class 4 impact, exhibits improved adhesion of the granules as measured by at least about 30% less granule loss in the area of impact compared with the same roofing material without the protective coating.

7. An asphalt-based rooting material comprising:

a substrate coated with an asphalt coating, the asphalt coating including an upper surface that is positioned above the substrate when the roofing material is installed on a roof, a protective unitary coating adhered to the upper surface of the asphalt coating, and a surface layer of granules adhered to the protective coating, wherein at least a portion of the granules penetrate the asphalt coating, and wherein the protective coating provides a seal to prevent outside moisture from flowing around the granules to the asphalt coating.

8. The roofing material of claim 1, wherein the web is fused to the lower region of the asphalt coating.

9. The roofing material of claim 8, the web improving the impact resistance of the roofing material such that, when tested under impact resistance test UL 2218, the roofing material exhibits an impact resistance improvement of at least two UL 2218 classes compared with the same roofing material without the web.

10. The roofing material of claim 3, wherein the protective layer is applied to the upper surface as a unitary layer.

11. The roofing material of claim 4, wherein the protective coating is extruded onto the upper surface of the asphalt coating.

12. The roofing material of claim 4, wherein the protective coating comprises one or more solidified film strips applied onto the upper surface of the asphalt coating, the strips being melted to form the unitary layer.

13. The roofing material of claim 4, wherein said protective coating comprises a particulate material applied onto the upper surface of the asphalt coating, the particulate material being melted to form the unitary layer.

14. The rooflig material of claim 2 which meets a UL 2218 Class 4 impact resistance standard.

15. The roofing material of claim 1 which, after aging by 60 days exposure to alternating cycles of concentrated solar radiation and water spray, then cooled to 14° F. (−10° C.) and subjected to a UL 2218 Class 4 impact, exhibits improved adhesion of the granules ms measured by at least about 30% less granule loss in the area of impact compared with the same roofing material without the protective coating.

16. The roofing material of claim 4 in which the protective coating has an average thickness of at least about 1 mil (0.025 mm).

17. The roofing material of claim 4 in which the protective coating comprises an adhesive.

18. The roofing material of claim 4 in which the coating material is selected so that the granules adhere to the coating material predominantly by polar bonding.

19. The roofing material of claim 4 in which the coating material is selected from the group consisting of ethylene-vinyl acetate copolymers, ethylene-vinyl acetate copolymers modified with styrene-butadiene-styrene block copolymers, ethylene-ethyl acetate copolymers, ethylene-n-butylacrylate polymers, ethylene-methacrylate polymers, styrene-isoprene-styrene block or graft copolymers, styrene-butadiene-styrene block or graft copolymers, other styrene-containing block or graft copolymers, polyamide terpolymers, hydrocarbon rubbers, polyethylenes, polyesters, polyurethanes, siloxanes, and mixtures of these materials.

20. The roofing material of claim 7 in which a substantially continuous layer of the protective coating is maintained between the asphalt coating and at least about 30% of the granules that penetrate the asphalt coating.

21. The roofing material of claim 7 which the protective coating completely envelops a number of the granules within the range of from about 0.5% to about 6% of the total granules.

* * * * *

UNITED STATES PATENT AND TRADEMARK OFFICE

CERTIFICATE OF CORRECTION

PATENT NO. : 6,709,994 B2
APPLICATION NO. : 10/055774
DATED : March 23, 2004
INVENTOR(S) : Miller It is certified that error appears in the above-identified patent and that said Letters Patent is hereby corrected as shown below:

Claim 2, Line 40, Column 14, “impart” should read --impact--
Claim 6, Line 1, Column 15, “UL 22 18” should read --UL 2218--
Claim 7, Line 6, Column 15, “rooting” should read --roofing--
Claim 15, Line 7, Column 16, “ms” should read --as--

Signed and Sealed this

Nineteenth Day of December, 2006

JON W. DUDAS
*Director of the United States Patent and Trademark Office*